United States Patent [19]

La Voque

[11] 4,210,377

[45] Jul. 1, 1980

[54] ELECTRICAL PLUG PULL

[76] Inventor: Edward C. La Voque, 342 NE. 2nd Ct., Dania, Fla. 33004

[21] Appl. No.: 1,298

[22] Filed: Jan. 5, 1979

[51] Int. Cl.[2] ..... H01R 13/62

[52] U.S. Cl. ..... 339/45 R

[58] Field of Search ..... 339/45, 46, 110

[56] References Cited

U.S. PATENT DOCUMENTS

| | | | |
|---|---|---|---|
| 2,962,197 | 11/1960 | Spangler, Jr. | 339/45 R |
| 3,160,947 | 12/1964 | Sunderlin | 339/45 R |

*Primary Examiner*—Joseph H. McGlynn

*Attorney, Agent, or Firm*—Oltman and Flynn

[57] ABSTRACT

This device is applied to a pronged electrical plug to make it easier to pull out an electrical socket. It has a thin, apertured central segment which extends across the pronged end of the plug and opposite, flexible legs which are overlapped and interlocked to provide a loop handle which the user may grasp. A pair of openings in the central segment for passing the ungrounded prongs on the plug are disposed at a substantial acute angle to the centerline of the opposite, flexible legs and are non-symmetrically positioned with respect to that centerline, so that the loop handle is to one side of the usual wiring cord connected to the plug.

6 Claims, 4 Drawing Figures

ELECTRICAL PLUG PULL

SUMMARY OF THE INVENTION

This invention relates to a device for pulling a pronged electrical plug out of an electrical socket.

Users of electrical appliances frequently damage the usual two-wire or three-wire electrical cord of the appliance by pulling directly on the cord to remove the usual pronged plug on the end of the cord from the electrical socket. In some cases the user does this out of carelessness. In other cases the user does it because of his or her difficulty in grasping the plug to remove it from the socket. In still other cases the user may fear receiving an electrical shock due to arcing which sometimes occurs between the socket and the plug when the plug is being removed from the socket. Whatever the user's reason, this technique of pulling directly on the cord is apt to pull at least one of the wires loose from its terminal in the plug, making the plug defective or possibly dangerous to the user.

The present invention is directed to a novel device to assist the user in pulling an electrical plug out of a socket.

In the preferred embodiment this device comprises a thin, flat, readily flexible, one-piece body of suitable dielectric material having an apertured central segment for engagement between the plug and the socket and opposite legs extending from the central segment and bendable into overlapping interlocked engagement to provide a handle loop which may be conveniently grasped by the user. The central segment has openings for passing the usual prongs on the plug, so that they may be received in the socket in the usual way.

A principal object of this invention is to provide a novel and improved plug pull for use in manually removing a pronged electrical plug from an electrical socket.

Another object of this invention is to provide such a plug pull which does not interfere with the insertion of the plug in the socket and the proper electrical connections between their respective terminals.

Another object of this invention is to provide such a novel plug pull which can be readily applied to or removed from the plug.

Further objects and advantages of this invention will be apparent from the following detailed description of a presently preferred embodiment which is shown in the accompanying drawing.

DETAILED DESCRIPTION

Figure 1:
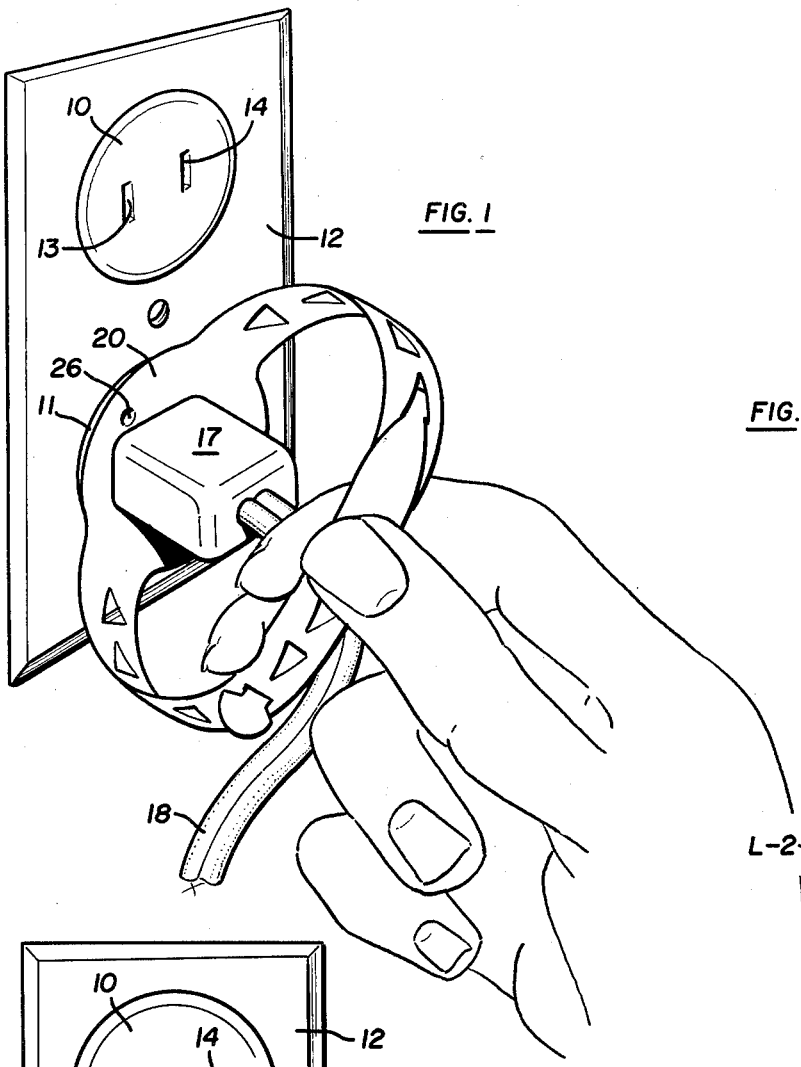
FIG. 1 is a perspective view showing the present invention applied to an electrical plug inserted in a wall socket.

Referring to FIG. 1, an electrical wall socket unit of known construction comprises an upper socket 10, an identical lower socket 11 and a cover plate 12. Each socket presents two recesses 13 and 14 where socket terminals (not shown) are located for snugly receiving, and making electrical contact with, two metal prongs 15 and 16 on an electrical plug 17, shown in phantom in FIG. 4. As shown in FIG. 1, the plug 17 is on the end of a two-wire electrical cord 18. The body of the plug 17 is of suitable electrical insulation and the two-wire cord 18 is covered with electrical insulation. The stranded copper wire in the cord 18 is anchored in the plug 17 and is connected conductively there to the respective plug prongs 15 and 16. It is to be understood that the electrical socket and plug assembly as described thus far is entirely conventional.

For various reasons, different users frequently pull such an electrical plug out of the socket by exerting a pull directly on the two-wire cord 18 instead of grasping the body of the plug 17. Users may do this simply out of laziness or carelessness, or because of an arthritic or other condition of the hand which makes it difficult or inconvenient to grasp the plug, or because of fear that arcing will occur between the socket terminals and the plug prongs while the plug is being removed.

In accordance with the present invention, a novel device for removable attachment to the plug is provided to facilitate pulling it out of the socket, so that the user will not be tempted to pull directly on the wiring cord.

Figure 2:
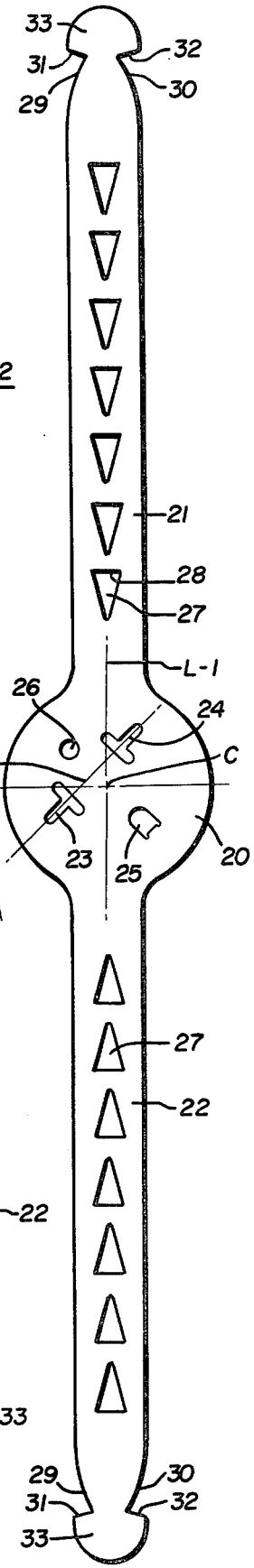
FIG. 2 is a plan view of the present plug pull.

Referring to FIG. 2, in the presently-preferred embodiment this device has a thin, flat, apertured, central segment 20 of a circular outline which is shaped and dimensioned to completely cover the front of a conventional in-wall electrical socket. Opposite, elongated, thin, flat legs 21 and 22 are formed integral with the apertured central segment 20 and extend away from it at diametrically opposed locations around the circumference of the central segment. Each leg 21 or 22 for most of its length has a width of about $\frac{1}{3}$ the diameter of the central segment 20, in one practical embodiment. The central segment 20 and the legs 21 and 22 preferably are composed of suitable dielectric plastic material which is resilient and thin enough to make the legs 21 and 22 readily flexible and twistable manually.

The central segment 20 is formed with a pair of T-shaped openings 23 and 24 which are spaced apart in accordance with the spacing between the prongs 15 and 16 on an electrical plug of standard American design. These openings are offset to one side of the center C of the central segment 20, and a third opening 25 is provided on the opposite side of this center to receive a ground-wire prong (not shown) on the plug when the electrical cord is one of the three-wire type (the third wire being the ground wire). A circular fourth opening 26 is provided on the same side of the center as the openings 23 and 24 and equidistant from both of them to accommodate an arrangement of plug prongs different from the accepted standard in the United States.

Figure 4:
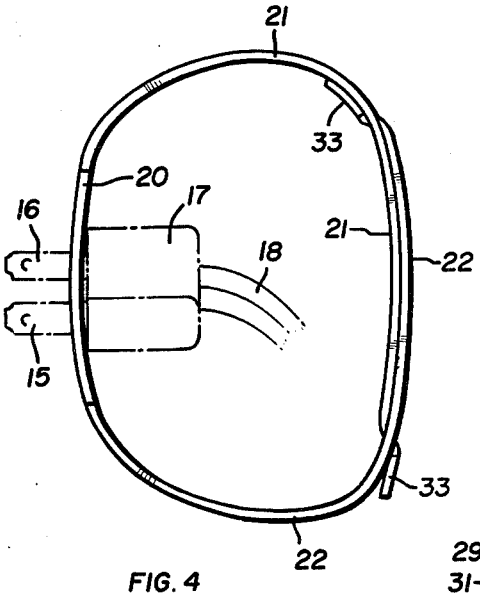
FIG. 4 is a view taken along the line 4—4 in FIG. 3, showing the present plug pull in full lines and the electrical plug in phantom.

As shown in FIGS. 1 and 4, the openings in the apertured central segment 20 of the present plug pull snugly pass the corresponding individual prongs on the plug and permit their insertion in the socket openings in the usual manner, with the thin central segment 20 being snugly engaged between the front of the socket and the end of the plug body 17 from which the prongs project.

Each of the elongated, flexible, opposite legs 21 and 22 of the present plug pull is formed with a plurality of generally triangular openings 27, which are spaced apart in succession along the length of that leg outwardly from the apertured central segment 20. Each of these openings is elongated lengthwise of the respective leg, with the apex of the triangle which it forms being disposed toward the apertured central segment 20 of the plug pull. Each opening 27 presents a base edge 28 located opposite its apex (i.e., away from the apertured central segment 20) and extending perpendicular to the length of the respective leg 21 or 22 of the plug pull. The width of the opening 27 along its base edge 28 is substantially less than its length from this base edge to the apex (i.e., lengthwise of the respective leg 21 or 22).

Near its outer end away from the apertured central segment, each leg 21 or 22 has its opposite edges converging inwardly toward each other, as shown at 29 and 30 in FIG. 2, to each form one side of a generally V-shaped notch in the respective side edge of that leg. The opposite side of the V-shaped notch is defined by the respective back edge 31 or 32 of a rounded end tab 33 on that leg. Each back edge 31 or 32 extends almost perpendicular to the length of the respective leg so as to provide a transverse edge. The width of each leg 21 or 22 at the V-notch behind its rounded end tab 33 is just slightly less than the width of each opening 27 in the opposite leg along its base edge 28.

As shown in FIGS. 1, 2 and 4, the opposite legs 21 and 22 of the plug pull may be interlocked in overlapping engagement with each other to provide a closed loop opposite the apertured central segment 20 which engages the plug 17. This is done by twisting each leg 21 or 22 through a quarter-turn behind its end tab 33, so that the plane of the twisted outer end of that leg is perpendicular to the plane of the other leg at the selected opening 27 in the latter. The end tab 33 of the twisted leg is inserted through the selected opening 27 in the other leg and then the twisted leg is released, at which time due to its resilience, its inserted end turns back 90 degrees to a position in which the reduced neck between the V-notches is next to the base edge 28 of the opening. The edges 31, 32 at the base of the inserted end extend laterally beyond the opening 27 on each side to prevent withdrawal of the end tab 33 to maintain the overlapped legs 21 and 22 interlocked with each other.

Figure 3:
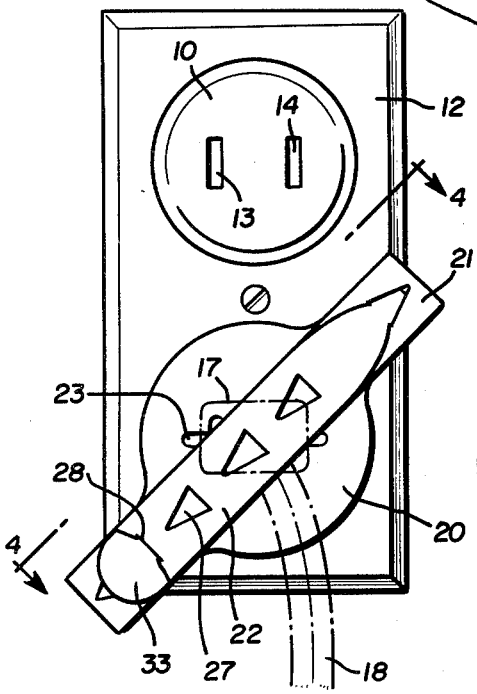
FIG. 3 is a front elevational view of the assembled plug, socket and the present plug pull as shown in FIG. 1.

The same interlock is provided at the outer end of the other leg, so that the outer end tab 33 of each leg is interlocked with the other leg at an opening 27 in the latter, as shown in FIGS. 1, 3 and 4.

As shown in FIG. 1, the overlapped and interlocked legs 21 and 22 form a handle loop which may be conveniently grasped by a person while pulling the inserted electrical plug out of the electrical socket.

As shown in FIG. 2, the openings 23 and 34 which receive the ungrounded prongs on the plug have a common centerline L-2 which extends at a substantial acute angle to the longitudinal centerline L-1 of the opposite flexible legs 21 and 22 of the present plug pull. Also, these two openings are positioned non-symmetrically with respect to the centerline L-1 of the legs 21 and 22. Consequently, when the present plug pull is on the plug and the ungrounded prongs 15 and 16 on the plug are in the socket, the loop handle formed by the overlapped and interlocked legs 21 and 22 extends at a substantial acute angle to a centerline between these prongs (which is horizontal in FIGS. 1 and 3) and is to one side of the wiring cord 18. This makes the loop handle readily accessible to be grasped by the user's hand without interference from the wiring cord 18.

I claim:

1. A plug pull for removing a pronged electrical plug from an electrical socket, said plug pull having:

a thin insulating segment for engagement between the front of the socket and the body of the plug, said segment having openings therein which are shaped and dimensioned to pass the prongs on the plug for reception in the socket;

handle means connected to said segment and projecting therefrom outwardly past the plug to be grasped by the user for pulling the plug out of the socket;

said handle means comprising opposite, elongated, flexible legs extending from opposite sides of said thin segment for overlapping engagement with each other outwardly of the plug to form a loop handle to be grasped by the user;

at least one of said legs having an opening therein which is elongated lengthwise of the leg, and the other of said legs having an outer end segment which is insertable through said opening and is turnable therein to a position in interlocking engagement with said one leg at said opening.

2. A plug pull according to claim 1, wherein said one leg has a plurality of said openings spaced apart in succession along its length.

3. A plug pull according to claim 1, wherein each of said legs has a plurality of said openings therein spaced apart in succession along its length, and each of said legs has said outer end segment thereon.

4. A plug pull for removing a pronged electrical plug from an electrical socket, said plug pull having:

a thin segment for engagement between the front of the socket and the body of the plug, said segment having openings therein which are shaped and dimensioned to pass the prongs on the plug for reception in the socket;

handle means connected to said segment and projecting therefrom outwardly past the plug to be grasped by the user for pulling the plug out of the socket;

said handle means comprising opposite, elongated, flexible legs extending from opposite sides of said thin segment for overlapping engagement with each other outwardly of the plug to form a loop handle to be grasped by the user;

said legs having respective interlock portions for manually releasable interlocking engagement with each other;

said thin segment having a pair of openings for receiving ungrounded prongs on the plug;

said pair of openings having a common center line extending at a substantial acute angle to the longitudinal centerline of said opposite flexible legs so that said loop handle extends at an acute angle to the centerline between said ungrounded prongs when the plug is in the socket.

5. A plug pull according to claim 4, wherein said pair of openings are non-symmetrically positioned with respect to said centerline of said opposite flexible legs.

6. A plug pull according to claim 5, wherein said thin segment is of dielectric material.

* * * * *